US009707447B1

(12) United States Patent
Lopez Babodilla et al.

(10) Patent No.: US 9,707,447 B1
(45) Date of Patent: Jul. 18, 2017

(54) EXERCISE TREADMILL FOR CHILDREN

(71) Applicants: Vielka Lopez Babodilla, Murrieta, CA (US); Marcelino Lopez, Murrieta, CA (US)

(72) Inventors: Vielka Lopez Babodilla, Murrieta, CA (US); Marcelino Lopez, Murrieta, CA (US)

( * ) Notice: Subject to any disclaimer, the term of this patent is extended or adjusted under 35 U.S.C. 154(b) by 0 days.

(21) Appl. No.: 15/135,052

(22) Filed: Apr. 21, 2016

(51) Int. Cl.
*A63B 24/00* (2006.01)
*A63B 22/02* (2006.01)

(52) U.S. Cl.
CPC ..... *A63B 24/0087* (2013.01); *A63B 22/02* (2013.01); *A63B 2208/12* (2013.01)

(58) Field of Classification Search
CPC . A63B 22/02; A63B 22/0235; A63B 2210/50; A63B 22/0023; A63B 24/0087; A63B 22/0285; A63B 23/04; A63B 2225/50; A63B 2071/065; A63B 2225/09; A63B 2225/093; A63B 22/025; A63B 2071/0625; A63B 2208/12
USPC ..... 482/8, 54
See application file for complete search history.

(56) References Cited

U.S. PATENT DOCUMENTS 3,870,297 A 3/1975 Elder
5,000,440 A * 3/1991 Lynch ..... A63B 21/0615 482/112
5,910,070 A * 6/1999 Henry ..... A63B 21/072 482/108
6,162,151 A 12/2000 Tani et al.
7,780,573 B1 8/2010 Carmein
7,892,148 B1 * 2/2011 Stauffer ..... A63B 22/0235 482/51
7,914,420 B2 * 3/2011 Daly ..... A63B 22/0235 119/700
2003/0148854 A1 * 8/2003 Wang ..... A63B 22/02 482/54
2003/0224908 A1 * 12/2003 Lin ..... A63B 22/02 482/54
2006/0160667 A1 * 7/2006 Oglesby ..... A63B 22/0023 482/54
2006/0281605 A1 * 12/2006 Lo ..... A63B 22/0023 482/54
2007/0105693 A1 * 5/2007 Wang ..... A63B 22/02 482/54
2008/0119332 A1 * 5/2008 Roman ..... A63B 71/0622 482/54
2008/0242510 A1 * 10/2008 Topel ..... A63B 22/0235 482/4

(Continued)

*Primary Examiner* — Andrew S Lo
(74) *Attorney, Agent, or Firm* — Stevenson IP, LLC

(57) ABSTRACT

An exercise treadmill for children including a treadmill having a base, a deck pivotally mounted on the base, an endless belt looped over the deck, a pair of support legs attached to the base, a drive mechanism coupled to the belt, an inclination control mechanism coupled to the deck, and a power cord. A support platform is attached to the pair of support legs. A display screen and a control panel is disposed on the support platform. Each of a right handle and a left handle of a pair of handles is disposed on each of a right handle support arm portion and a left handle support arm portion of the support platform, respectively. A plurality of light emitting diodes is disposed on each of the right handle and the left handle, and at least one light emitting diode is disposed on the deck of the treadmill.

2 Claims, 6 Drawing Sheets

(56) References Cited

U.S. PATENT DOCUMENTS

| | | | | |
|---|---|---|---|---|
| 2009/0239716 | A1* | 9/2009 | Wang | A63B 22/0235 482/54 |
| 2011/0082013 | A1* | 4/2011 | Bastian | A63B 22/0235 482/54 |
| 2012/0083368 | A1* | 4/2012 | Ganuza | A63B 21/0552 473/446 |
| 2013/0035208 | A1* | 2/2013 | Dalebout | A63B 24/0062 482/8 |
| 2013/0267387 | A1* | 10/2013 | Watterson | A63B 22/02 482/54 |
| 2014/0066263 | A1* | 3/2014 | Huang | A63B 71/0054 482/54 |
| 2014/0113770 | A1* | 4/2014 | Yim | A63B 22/025 482/8 |
| 2015/0238819 | A1* | 8/2015 | Volkerink | A63B 24/0087 482/4 |
| 2015/0352401 | A1* | 12/2015 | Johnson | A63B 22/0235 482/54 |
| 2015/0367169 | A1* | 12/2015 | Ashby | G10K 11/178 482/4 |
| 2016/0023049 | A1* | 1/2016 | Dalebout | A63B 22/0242 482/7 |
| 2016/0088931 | A1* | 3/2016 | Schneider | A47B 21/03 108/28 |
| 2016/0107065 | A1* | 4/2016 | Brammer | A63B 24/0087 482/8 |
| 2016/0144238 | A1* | 5/2016 | Brunner | A63B 24/0075 482/9 |

* cited by examiner

EXERCISE TREADMILL FOR CHILDREN

BACKGROUND OF THE INVENTION

Various types of treadmills are known in the prior art. However, what has been needed is an exercise treadmill for children including a treadmill having a base, a deck pivotally mounted on the base, an endless belt looped over the deck, a pair of support legs attached to the base, a drive mechanism coupled to the belt, an inclination control mechanism coupled to the deck, and a power cord. What has been further needed is a support platform attached to the pair of support legs, with a display screen and a control panel disposed on the support platform. Each of a right handle and a left handle of a pair of handles is disposed on each of a right handle support arm portion and a left handle support arm portion of the support platform, respectively. Lastly, what has been needed is a plurality of light emitting diodes disposed on each of the right handle and the left handle, and at least one light emitting diode disposed on the deck of the treadmill. A remote control is optionally in wireless communication with a central processing unit disposed in the treadmill. The exercise treadmill for children is specifically and uniquely structured to encourage children, preferably under the age of sixteen years ago, to workout and maintain a healthy lifestyle. The specific structural differences that will better encourage children to use the treadmill are the plurality of light emitting diodes, the at least one light emitting diode, and the optional remote control, which allows for the treadmill to be remotely controlled by a parent of the child.

FIELD OF THE INVENTION

The present invention relates to treadmills, and more particularly, to an exercise treadmill for children.

SUMMARY OF THE INVENTION

The general purpose of the present exercise treadmill for children, described subsequently in greater detail, is to provide an exercise treadmill for children which has many novel features that result in an exercise treadmill for children which is not anticipated, rendered obvious, suggested, or even implied by prior art, either alone or in combination thereof.

To accomplish this, the present exercise treadmill for children includes a treadmill having a base, a deck pivotally mounted on the base, an endless belt looped over the deck, a pair of upright support legs attached to the base, a drive mechanism coupled to the belt, an inclination control mechanism coupled to the deck, and a power cord removably attachable to a power source. Each of the pair of upright support legs and the deck has a right side, a left side, a top side, a bottom side, a front side, and a back side. A single continuous U-shaped support platform is attached to the top side of each of the pair of support legs. The support platform has a rearwardly extended right handle support arm portion, a rearwardly extended left handle support arm portion, and a middle portion disposed between the right handle support arm portion and the left handle support arm portion. Each of the right handle support arm portion, the left handle support arm portion, and the middle portion has a top surface and a bottom surface.

The exercise treadmill for children further includes a substantially upright display screen medially disposed on the top surface of the middle portion of the support platform. The display screen is optionally a touch screen to allow a child to easily select one of a plurality of simulated exercise routes to be displayed on the display screen during his workout. The display screen is configured to display one of a plurality of simulated exercise routes depending upon the selection of the child. A control panel is disposed on the top surface of the middle portion of the support platform proximal the display screen. The control panel has a plurality of primary controls including a primary activation control, a primary stop control, a primary elevation control, and a primary speed control. The primary activation control is configured to activate the treadmill. The primary stop control is configured to halt the drive mechanism of the treadmill to stop movement of the belt. The primary elevation control is configured to raise and, alternately, to lower the elevation of the deck of the treadmill, and the primary speed control is configured to increase and, alternately, to decrease the speed of the belt of the treadmill. Since it is envisioned that the treadmill will be primarily utilized by children less than sixteen years of age, the treadmill will have a slower range of speeds than a normal treadmill. A central processing unit is disposed within the base of the treadmill. Each of a right handle and a left handle of a pair of inverted U-shaped rearwardly extended handles has an outer surface and an inner surface. Each of the right handle and the left handle is disposed on the top surface of each of the right handle support arm portion and the left handle support arm portion, respectively. A plurality of light emitting diodes is continuously disposed on the outer surface of each of the right handle and the left handle, and at least one light emitting diode is disposed on at least one of the right side of the deck of the treadmill and the left side of the deck of the treadmill. The drive mechanism of the treadmill, the inclination control mechanism of the treadmill, the power source, the display screen, the primary activation control, the primary stop control, the primary elevation control, the primary speed control, the central processing unit, the plurality of light emitting diodes, and the at least one light emitting diode are in operational communication. The plurality of light emitting diodes and the at least one light emitting diode illuminate in order to help motivate the child during his workout. The exercise treadmill for children optionally includes a remote control having a plurality of secondary controls. The plurality of secondary controls includes a secondary activation control, a secondary stop control, a secondary elevation control, and a secondary speed control. The remote control is in wireless communication with the central processing unit. A battery compartment is disposed within the remote control, with a battery removably disposed within the battery compartment. The secondary activation control is configured to activate the treadmill. The secondary stop control is configured to halt the drive mechanism of the treadmill to stop movement of the belt. The secondary elevation control is configured to raise and, alternately, to lower the elevation of the deck of the treadmill, and the secondary speed control is configured to increase and, alternately, to decrease the speed of the belt of the treadmill. The optional remote control allows for a parent of the child to control the settings of the treadmill while the child exercises on the treadmill.

Thus has been broadly outlined the more important features of the present exercise treadmill for children so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
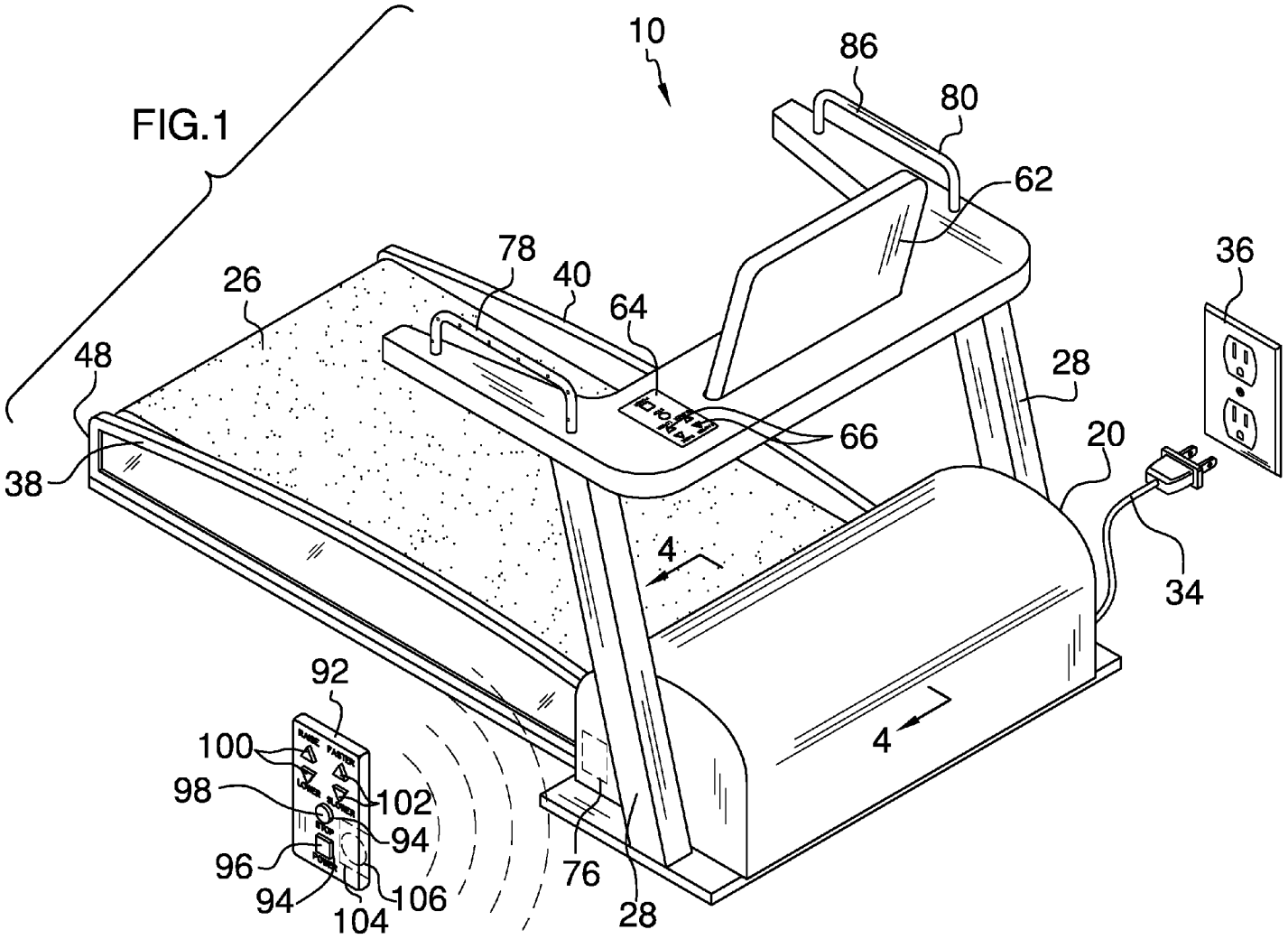
FIG. 1 is a front isometric view.
Figure 2:
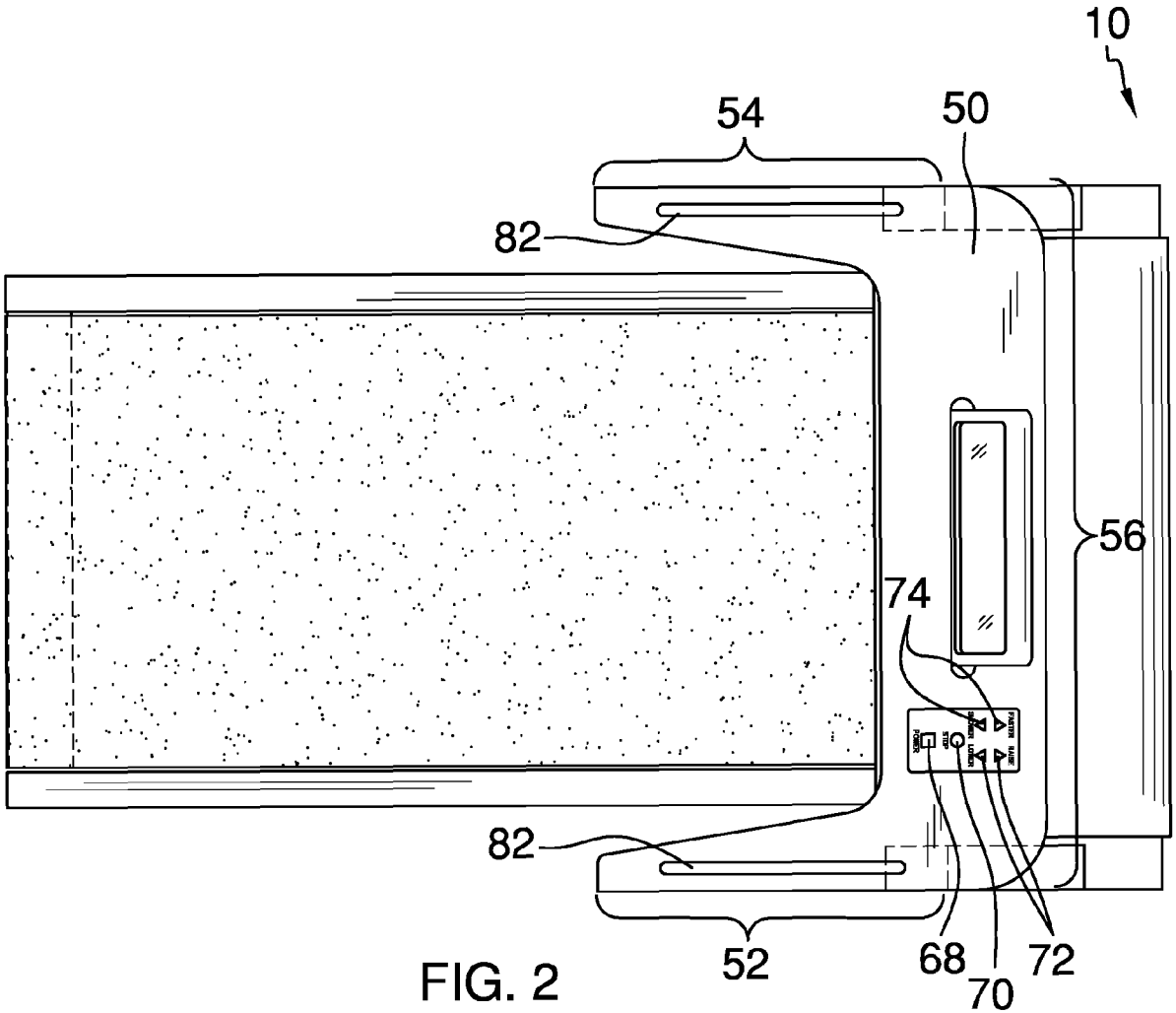
FIG. 2 is a top plan view.
Figure 3:
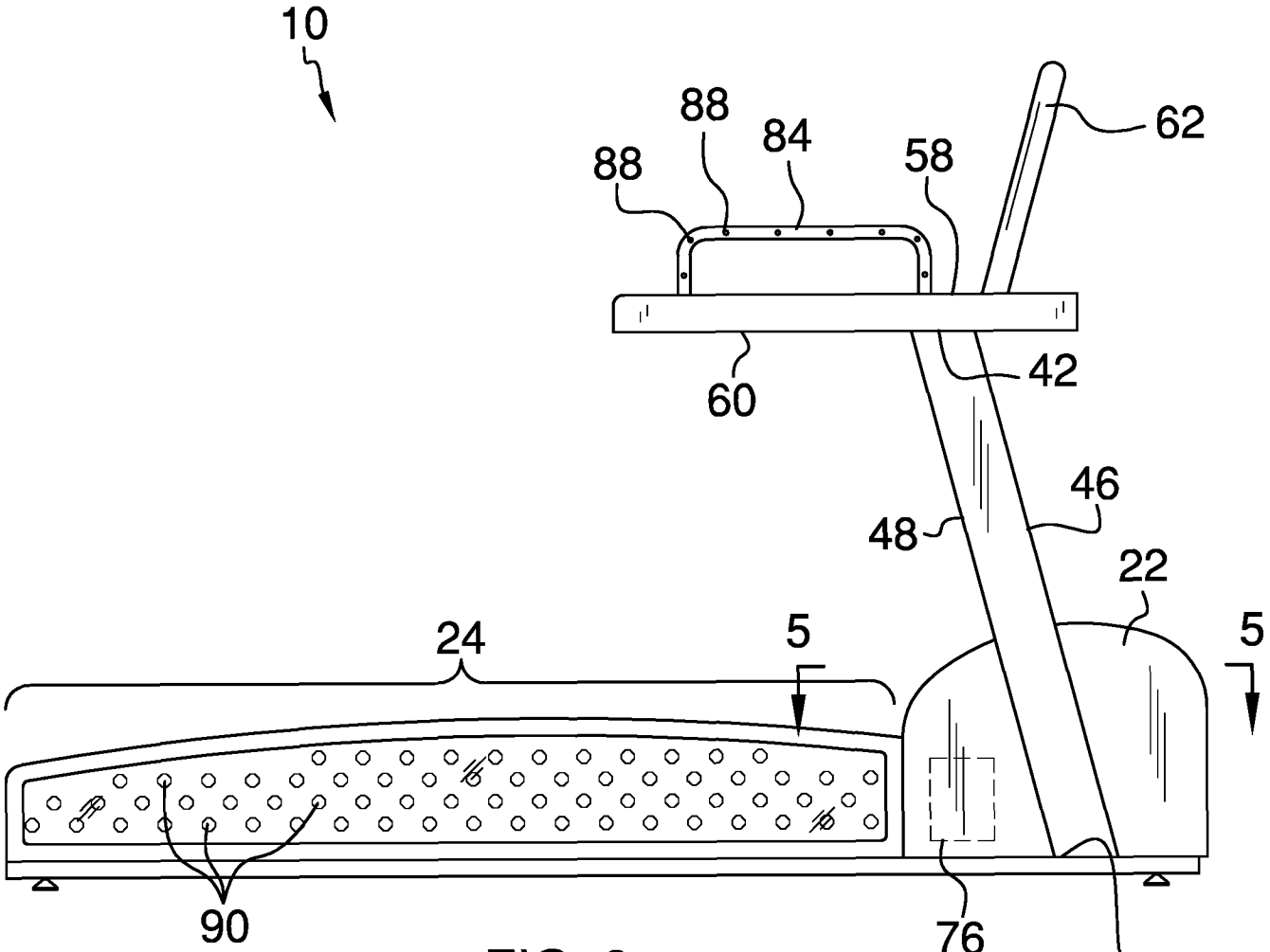
FIG. 3 is a side elevation view.
Figure 4:
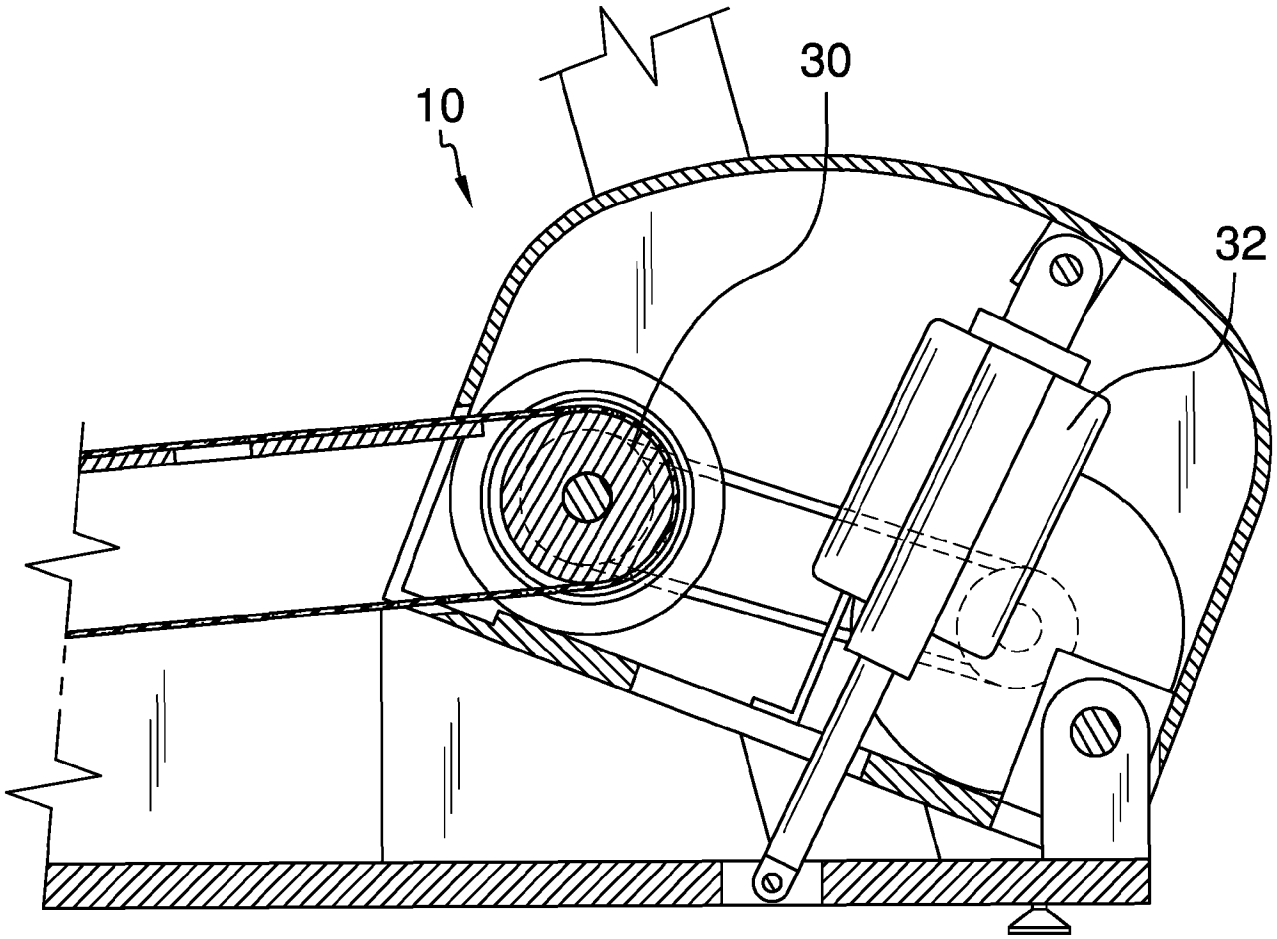
FIG. 4 is a cross-sectional view taken along line 4-4 of FIG. 1.
Figure 5:
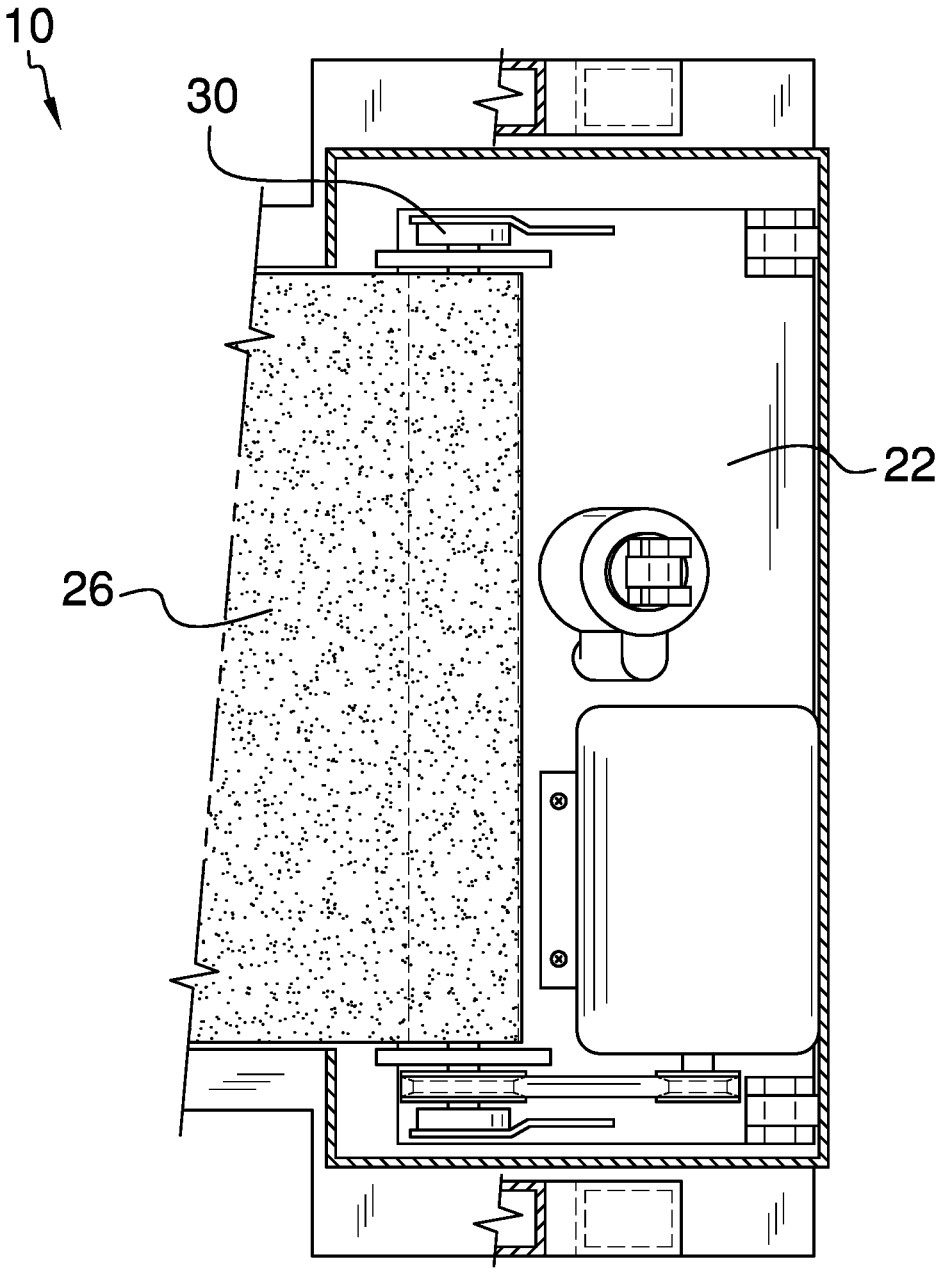
FIG. 5 is a cross-sectional view taken along line 5-5 of FIG. 3.
Figure 6:
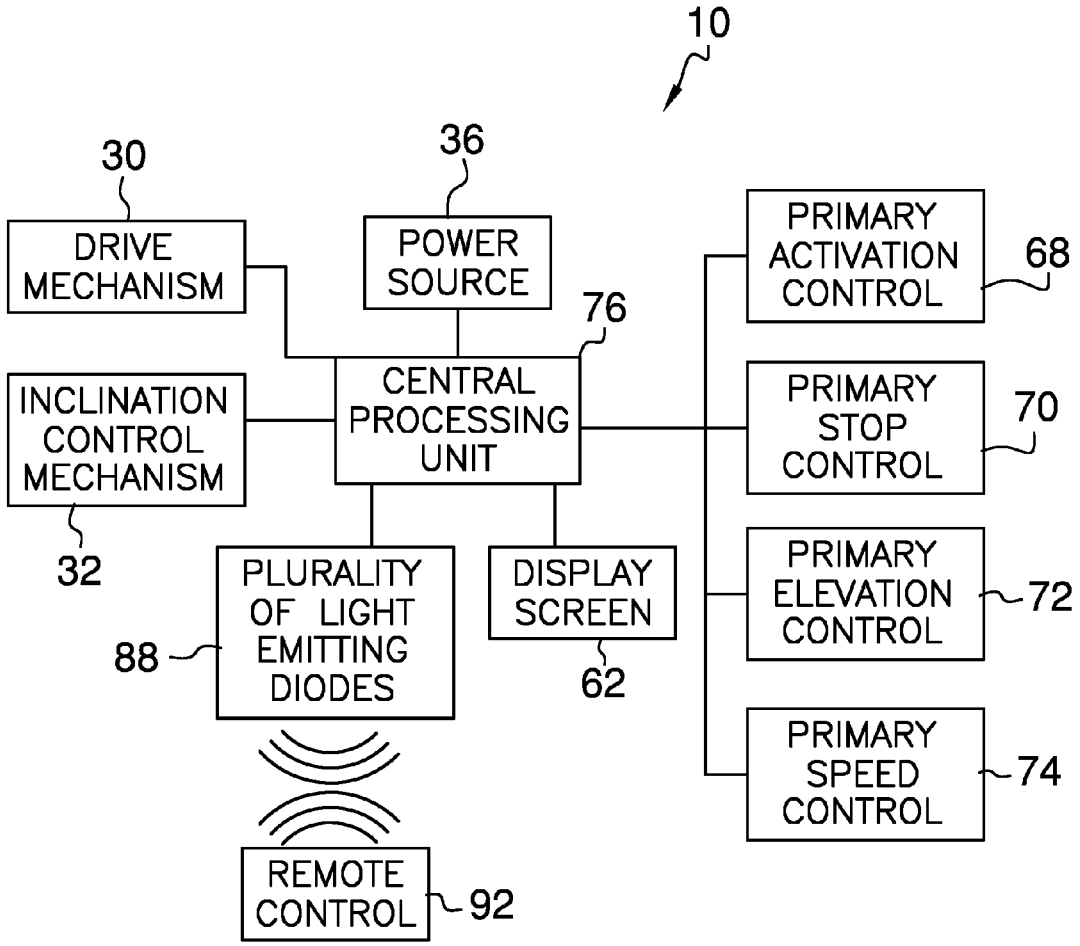
FIG. 6 is a block diagram.

With reference now to the drawings, and in particular FIGS. 1 through 6 thereof, an example of the instant exercise treadmill for children employing the principles and concepts of the present exercise treadmill for children and generally designated by the reference number 10 will be described.

Referring to FIGS. 1 through 6 the present exercise treadmill for children 10 is illustrated. The exercise treadmill for children 10 includes a treadmill 20 having a base 22, a deck 24 pivotally mounted on the base 22, an endless belt 26 looped over the deck 24, a pair of upright support legs 28 attached to the base 22, a drive mechanism 30 coupled to the belt 26, an inclination control mechanism 32 coupled to the deck 24, and a power cord 34 removably attachable to a power source 36. Each of the pair of upright support legs 28 and the deck 24 has a right side 38, a left side 40, a top side 42, a bottom side 44, a front side 46, and a back side 48. A single continuous U-shaped support platform 50 is attached to the top side 42 of each of the pair of support legs 28. The support platform 50 has a rearwardly extended right handle support arm portion 52, a rearwardly extended left handle support arm portion 54, and a middle portion 56 disposed between the right handle support arm portion 52 and the left handle support arm portion 54. Each of the right handle support arm portion 52, the left handle support arm portion 54, and the middle portion 56 has a top surface 58 and a bottom surface 60. The exercise treadmill for children 10 further includes a substantially upright display screen 62 medially disposed on the top surface 58 of the middle portion 56 of the support platform 50. A control panel 64 is disposed on the top surface 58 of the middle portion 56 of the support platform 50 proximal the display screen 62. The control panel 64 has a plurality of primary controls 66 including a primary activation control 68, a primary stop control 70, a primary elevation control 72, and a primary speed control 74. The primary activation control 68 is configured to activate the treadmill 20. The primary stop control 70 is configured to halt the drive mechanism of the treadmill 20 to stop movement of the belt 26. The primary elevation control 72 is configured to raise and, alternately, to lower the elevation of the deck 24 of the treadmill 20, and the primary speed control 74 is configured to increase and, alternately, to decrease the speed of the belt 26 of the treadmill 20. A central processing unit 76 is disposed within the base 22 of the treadmill 20.

Each of a right handle 78 and a left handle 80 of a pair of inverted U-shaped rearwardly extended handles 82 has an outer surface 84 and an inner surface 86. Each of the right handle 78 and the left handle 80 is disposed on the top surface 58 of each of the right handle support arm portion 52 and the left handle support arm portion 54, respectively. A plurality of light emitting diodes 88 is continuously disposed on the outer surface 84 of each of the right handle 78 and the left handle 80, and at least one light emitting diode 90 is disposed on at least one of the right side 38 of the deck 24 of the treadmill 20 and the left side 40 of the deck 24 of the treadmill 20. The drive mechanism of the treadmill 30, the inclination control mechanism of the treadmill 32, the power source 36, the display screen 62, the primary activation control 68, the primary stop control 70, the primary elevation control 72, the primary speed control 74, the central processing unit 76, the plurality of light emitting diodes 88, and the at least one light emitting diode 90 are in operational communication.

The exercise treadmill for children 10 optionally includes a remote control 92 having a plurality of secondary controls 94. The plurality of secondary controls 94 includes a secondary activation control 96, a secondary stop control 98, a secondary elevation control 100, and a secondary speed control 102. The remote control 92 is in wireless communication with the central processing unit 76. A battery compartment 104 is disposed within the remote control 92, with a battery 106 removably disposed within the battery compartment 104. The secondary activation control 96 is configured to activate the treadmill 20. The secondary stop control 98 is configured to halt the drive mechanism of the treadmill 30 to stop movement of the belt 26. The secondary elevation control 100 is configured to raise and, alternately, to lower the elevation of the deck 24 of the treadmill 20, and the secondary speed control 102 is configured to increase and, alternately, to decrease the speed of the belt 26 of the treadmill 20.

What is claimed is:

1. An exercise treadmill for children comprising:

a treadmill having a base, a deck pivotally mounted on the base, an endless belt looped over the deck, a pair of upright support legs attached to the base, a drive mechanism coupled to the belt, an inclination control mechanism coupled to the deck, and a power cord removably attachable to a power source, wherein each of the pair of upright support legs and the deck has a right side, a left side, a top side, a bottom side, a front side, and a back side;

a single continuous U-shaped support platform attached to the top side of each of the pair of support legs, the support platform having a rearwardly extended right handle support arm portion, a rearwardly extended left handle support arm portion, and a middle portion disposed between the right handle support arm portion and the left handle support arm portion, each of the right handle support arm portion, the left handle support arm portion, and the middle portion having a top surface and a bottom surface;

a substantially upright display screen medially disposed on the top surface of the middle portion of the support platform;

wherein the display screen is configured to display one of a plurality of simulated exercise routes depending upon the selection of a child;

a control panel disposed on the top surface of the middle portion of the support platform proximal the display screen, the control panel having a plurality of primary controls comprising a primary activation control, a primary stop control, a primary elevation control, and a primary speed control;

wherein the primary activation control is configured to activate the treadmill;

wherein the primary stop control is configured to halt the drive mechanism of the treadmill to stop movement of the belt;

wherein the primary elevation control is configured to raise and, alternately, to lower the elevation of the deck of the treadmill;

wherein the primary speed control is configured to increase and, alternately, to decrease the speed of the belt of the treadmill;

a central processing unit disposed within the base of the treadmill;

a pair of inverted U-shaped rearwardly extended handles comprising a right handle and a left handle, each of the right handle and the left handle having an outer surface and an inner surface, wherein each of the right handle and the left handle is disposed on the top surface of each of the right handle support arm portion and the left handle support arm portion, respectively;

a plurality of light emitting diodes continuously disposed on the outer surface of each of the right handle and the left handle; and at least one light emitting diode disposed on at least one of the right side of the deck of the treadmill and the left side of the deck of the treadmill;

wherein the drive mechanism of the treadmill, the inclination control mechanism of the treadmill, the power source, the display screen, the primary activation control, the primary stop control, the primary elevation control, the primary speed control, the central processing unit, the plurality of light emitting diodes, and the at least one light emitting diode are in operational communication;

wherein the plurality of light emitting diodes and the at least one light emitting diode is configured to activate when a user has activated the treadmill.

2. The exercise treadmill for children of claim 1 further comprising:

a remote control having a plurality of secondary controls comprising a secondary activation control, a secondary stop control, a secondary elevation control, and a secondary speed control, wherein the remote control is in wireless communication with the central processing unit;

a battery compartment disposed within the remote control;

a battery removably disposed within the battery compartment;

wherein the secondary activation control is configured to activate the treadmill;

wherein the secondary stop control is configured to halt the drive mechanism of the treadmill to stop movement of the belt;

wherein the secondary elevation control is configured to raise and, alternately, to lower the elevation of the deck of the treadmill;

wherein the secondary speed control is configured to increase and, alternately, to decrease the speed of the belt of the treadmill.

* * * * *